US012123603B2

(12) United States Patent
Fiegen et al.

(10) Patent No.: US 12,123,603 B2
(45) Date of Patent: Oct. 22, 2024

(54) HVACR SYSTEM WITH ZONE HEATING

(71) Applicant: TRANE INTERNATIONAL INC., Davidson, NC (US)

(72) Inventors: Brian J. Fiegen, La Crosse, WI (US); John Arthur Murphy, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 261 days.

(21) Appl. No.: 17/646,243

(22) Filed: Dec. 28, 2021

(65) Prior Publication Data

US 2023/0204228 A1 Jun. 29, 2023

(51) Int. Cl.
*F24F 1/009* (2019.01)
*F24F 1/0007* (2019.01)
*F24F 11/83* (2018.01)

(52) U.S. Cl.
CPC ..... *F24F 1/009* (2019.02); *F24F 1/00077* (2019.02); *F24F 11/83* (2018.01)

(58) Field of Classification Search
CPC ..... F24F 1/009; F24F 1/00077; F24F 11/83; F24F 3/0525; F24F 3/06; F24F 11/81; F24F 12/003; F24F 2003/005
See application file for complete search history.

(56) References Cited

U.S. PATENT DOCUMENTS 2,975,609 A 3/1961 Allander et al.
3,820,713 A 6/1974 Demaray
4,024,728 A * 5/1977 Gustafsson ..... F24F 11/81 62/324.1
4,104,890 A * 8/1978 Iwasaki ..... F24F 5/0003 62/324.1
4,124,998 A * 11/1978 Swiderski ..... F24F 11/83 62/442
4,142,574 A 3/1979 Shavit
4,949,547 A * 8/1990 Shimizu ..... F24F 5/0003 62/238.7
2020/0088439 A1* 3/2020 Bhosale ..... F24F 12/006

OTHER PUBLICATIONS

Extended European Search Report, European Patent Application No. 22213802.6, Apr. 21, 2023 (7 pages).

* cited by examiner

*Primary Examiner* — Lionel Nouketcha
(74) *Attorney, Agent, or Firm* — HSML P.C.

(57) ABSTRACT

Methods for providing heating or cooling to a plurality of zones in a conditioned space, include adjusting a temperature of a primary airflow using a heating, ventilation, air conditioning, and refrigeration (HVACR) system including a heat pump circuit and distributing the primary airflow to a plurality of terminals in the zones. The methods further include directing heat from the heat pump circuit to at least one of the plurality of terminals and heating air at the at least one of the plurality of terminals using the heat directed from the heat pump circuit. The methods can further include utilizing sources and sinks of the heat pump circuit to efficiently provide the heating or cooling. Systems include the heat pump circuit, terminals, heat distribution, and can include a controller to operate those components.

14 Claims, 3 Drawing Sheets

HVACR SYSTEM WITH ZONE HEATING

FIELD

This disclosure is directed to systems and methods for providing heating, ventilation, air conditioning, and refrigeration (HVACR) including heating at particular zones in a variable air volume (VAV) system.

BACKGROUND

Variable air volume (VAV) systems can be used to provide heating and cooling to structures, particularly where there are distinct zones to be heated or cooled. However, VAV systems typically require heating to be provided by methods having comparatively low coefficients of performance (COP), such as gas burner heating or the use of local electric heaters.

SUMMARY

This disclosure is directed to systems and methods for providing heating, ventilation, air conditioning, and refrigeration (HVACR) including heating at particular zones in a variable air volume (VAV) system.

By providing a packaged heating, ventilation, air conditioning and refrigeration (HVACR) system providing central cooling and local reheating or heating for a plurality of zones, the packaged HVACR system can provide improved efficiency. For example, utilizing heat obtained by operation of an HVACR system can provide heating at the terminals and can allow higher coefficient of performance (COP) heating compared to systems using individual burners or electric heaters to provide heating at particular zones. Further, such an HVACR system can allow for fully electrically powered embodiments. In embodiments, the HVACR system can further include a centralized heat source to supplement heat being captured for distribution to the zones for the local reheating or heating operations at those zones.

In an embodiment, a method for providing heating or cooling to a plurality of zones in a conditioned space includes adjusting a temperature of a primary airflow using a heating, ventilation, air conditioning, and refrigeration (HVACR) system including a heat pump circuit. The method further includes distributing the primary airflow to a plurality of terminals, each of the plurality of zones being associated with at least one of the plurality of terminals. The method also includes directing heat from the heat pump circuit to at least one of the plurality of terminals and heating air at the at least one of the plurality of terminals using the heat directed from the heat pump circuit.

In an embodiment, the heat pump circuit further includes an exhaust heat recovery and a second heat exchanger, and the method further comprises determining utilization of the exhaust heat recovery and the second heat exchanger as sources or sinks for heat in the heat pump circuit. In an embodiment, the determination of utilization of the exhaust heat recovery and the second heat exchanger is based on an energy consumption for operation of the heat pump circuit.

In an embodiment, the method further includes determining whether additional heat is to be added, and when additional heat is to be added and using a heater to add heat to the primary airflow prior to the adjustment of the temperature of the primary airflow using the heat pump circuit.

In an embodiment, directing heat from the heat pump circuit to the at least one of the plurality of terminals includes heating a process fluid using heat from the heat pump circuit and circulating the process fluid to the at least one of the plurality of terminals.

In an embodiment, directing heat from the heat pump circuit to the at least one of the plurality of terminals includes directing hot working fluid from the heat pump circuit to the at least one of the plurality of terminals. In an embodiment, the hot working fluid is in a gaseous state. In an embodiment, directing the hot working fluid includes directing working fluid including the hot working fluid through a branch controller.

In an embodiment, the heat directed from the heat pump circuit to at least one of the plurality of terminals is obtained at least in part from a heat exchanger configured to exchange heat with an exhaust airflow of the HVACR system.

In an embodiment, the heat directed from the heat pump circuit to at least one of the plurality of terminals is obtained at least in part from operation of the heat pump circuit to adjust the temperature of the primary airflow.

In an embodiment, a heating, ventilation, air conditioning, and refrigeration (HVACR) system includes a heat pump circuit configured to exchange heat with a primary airflow and a duct system configured to distribute the primary airflow to a plurality of terminals. Each of the plurality of terminals includes a heat exchanger. Each of the plurality of terminals is associated with one or more of a plurality of zones of a conditioned space. The HVACR system further includes a heat distributor configured to direct heat from the heat pump circuit to the heat exchangers of the plurality of terminals such that the heat exchanger of at least one of the plurality of terminals adds heat to air at the at least one of the plurality of terminals.

In an embodiment, the heat pump circuit includes a heat recovery and a second heat exchanger configured to exchange heat with a source, and the HVACR system further comprises a controller configured to determine utilization of the heat recovery and the second heat exchanger as sources or sinks for heat in the heat pump circuit. In an embodiment, the controller is configured to determine utilization of the heat recovery exchanger and the second heat exchanger as sources or sinks for heat in the heat pump circuit based on an energy consumption of operation for the heat pump circuit.

In an embodiment, the HVACR system further includes a heater located upstream of a location where the heat pump circuit is configured to exchange heat with the primary airflow.

In an embodiment, the HVACR system further includes a controller configured to determine an additional heat requirement and to operate the heater based on the additional heat requirement.

In an embodiment, the heat distributor includes a heat exchanger configured to allow working fluid of the heat pump circuit to reject heat to a process fluid, and process fluid piping configured to distribute the process fluid to the heat exchangers of the plurality of terminals. In an embodiment, the process fluid includes water.

In an embodiment, the heat distributor includes a branch controller configured to separate hot gaseous working fluid from a working fluid flow of the heat pump circuit and working fluid piping configured to distribute the hot gaseous working fluid to the heat exchangers of the plurality of terminals.

DRAWINGS

DETAILED DESCRIPTION

This disclosure is directed to systems and methods for providing heating, ventilation, air conditioning, and refrigeration (HVACR) including heating at particular zones in a variable air volume (VAV) system.

Figure 1:
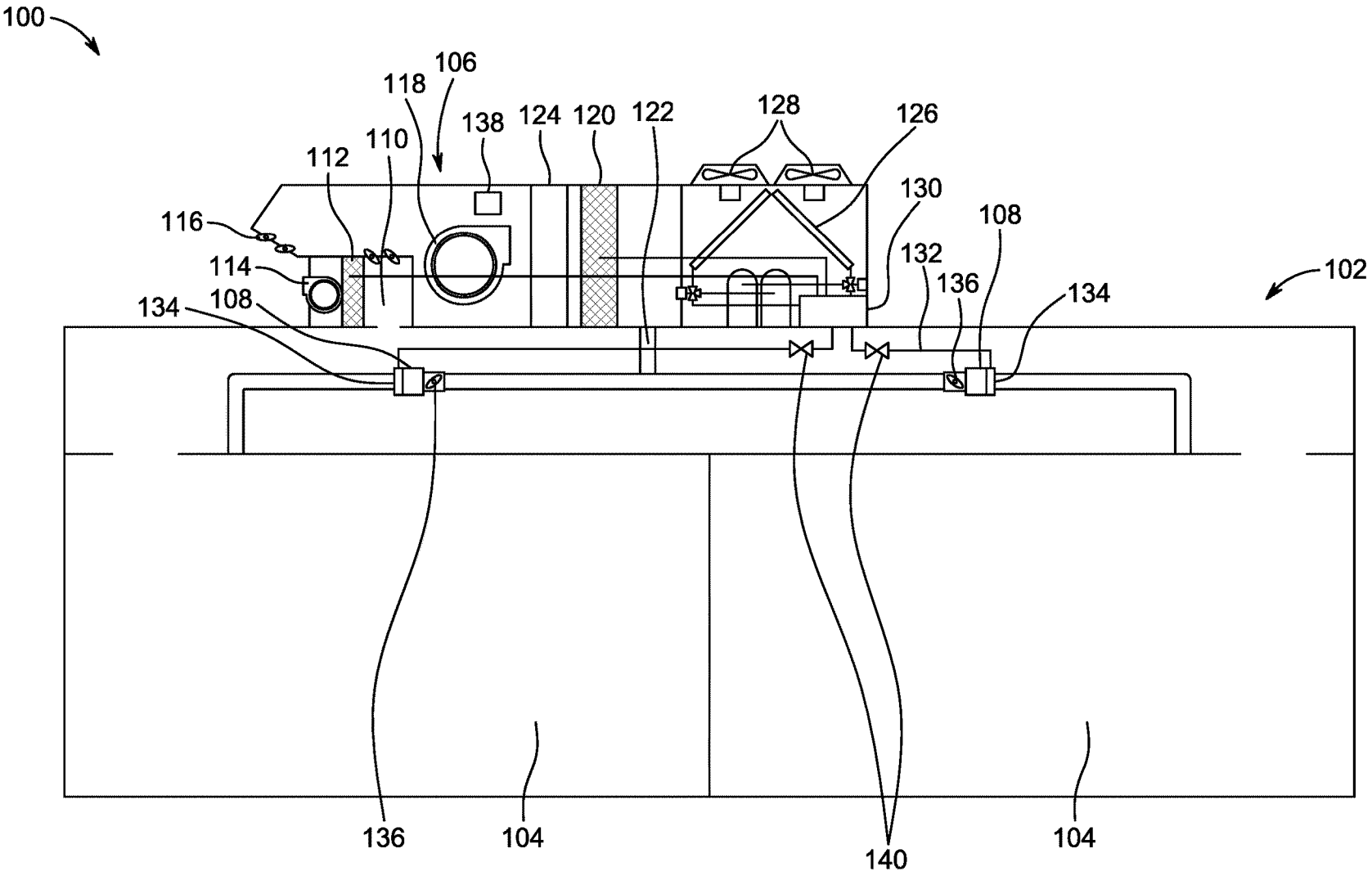
FIG. 1 shows a schematic of a heating, ventilation, air conditioning, and refrigeration (HVACR) system according to an embodiment.

FIG. 1 shows a schematic of a heating, ventilation, air conditioning, and refrigeration (HVACR) system according to an embodiment. HVACR system 100 provides air to conditioned space 102. Conditioned space 102 includes a plurality of zones 104. HVACR system 100 includes a main unit 106 and a plurality of terminals 108. Main unit 106 includes return air inlet 110, exhaust heat recovery 112, and exhaust blower 114. Main unit 106 further includes fresh air inlet 116, main blower 118, first heat exchanger 120, and supply ducting 122. Optionally, a heater 124 can be included upstream of first heat exchanger 120. The main unit 106 further includes second heat exchangers 126 and second heat exchanger blowers 128. The main unit also includes heat distributor 130. Heat distributor 130 can be coupled to heat distribution lines 132. Each of the terminals 108 includes a heating heat exchanger 134 and flow control 136. HVACR system 100 can further include a controller 138.

Conditioned space 102 is a space receiving air conditioned by the HVACR system 100, such as, for example, one or more buildings. The conditioned space includes a plurality of zones 104. The zones 104 can be discrete locations such as different buildings or different units within one building, different segments of a particular location such as areas in a building, or any other division of areas within the conditioned space 102. The zones 104 can each include one or more of the terminals 108. In an embodiment, the zones 104 can have different settings for the conditioned air being received, such as different thermostat settings or the like.

Figure 3:
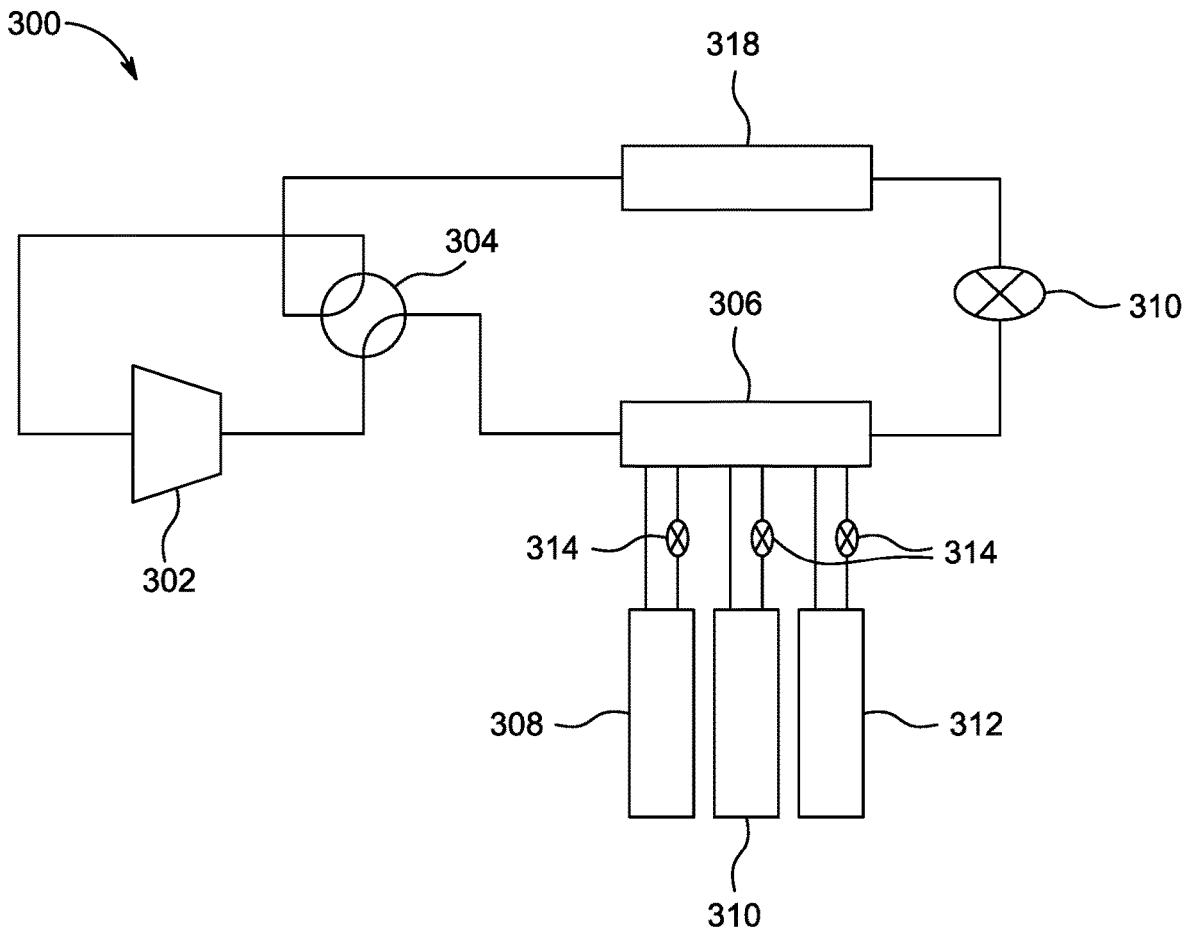
FIG. 3 shows an example of a working fluid circuit for an HVACR system according to an embodiment.

Main unit 106 can be, for example, a rooftop HVACR unit or any other suitable main or central HVACR unit. Main unit 106 can be configured to adjust a temperature of an airflow at one location, with the airflow then distributed to the plurality of terminals 108. Main unit 106 can include a working fluid circuit for absorbing and/or rejecting heat. The working fluid circuit of main unit 106 can include, for example, first heat exchanger 120, second heat exchangers 126, and optionally exhaust heat recovery 112. The working fluid circuit can further include a compressor. The working fluid circuit can be a heat pump circuit. The working fluid circuit can be reversible. An example embodiment of a working fluid circuit of main unit 106 is shown in FIG. 3 and described below. In an embodiment, the working fluid circuit can be configured to operate in a heating mode where first heat exchanger 120 is operating as a condenser, and second heat exchangers 126 are operating as evaporators. In an embodiment, the working fluid circuit can be configured to operate in a cooling mode where first heat exchanger 120 is operating as an evaporator and second heat exchanger 126 are operating as condensers. The working fluid circuit can utilize any suitable source, for example an air source, a water source, a ground source, or the like. In an embodiment, the working fluid circuit is an air-to-water heat pump. In an embodiment, the working fluid circuit is an air-to-air heat pump. In an embodiment, main unit 106 can be arranged as a split system with first heat exchanger 120 and second heat exchangers 126 provided in discrete units of the HVACR system 100.

Terminals 108 be provided within the conditioned space 102. Each of terminals 102 may be located in or otherwise supplying air to one of zones 104. In an embodiment, each of zones 104 receives air from at least one of the terminals 108. Terminals 108 can each receive air by way of supply ducting 122. The air directed to each of terminals 108 can be a portion of a primary airflow that is supplied from the main unit 106. Each of terminals 108 can include a heating heat exchanger 134. The heating heat exchanger 134 can be used to add heat to air at that respective terminal 108 to achieve a desired temperature for that terminal 108. The heating heat exchanger 134 can be any suitable heat exchanger for exchanging heat from a fluid received from heat distributor 130 to air of the airflow received at terminal 108 to be distributed to its respective zone 104. The terminals 108 can each further include a flow control 136. The flow control 136 can be any suitable device for controlling airflow out of the terminal 108 into its corresponding zone 104. As a non-limiting example, flow control 136 can be controllable louvers.

Main unit 106 includes a return air inlet 110. The return air inlet 110 is configured to receive air from the conditioned space 102, for example from return air ducting (not shown) provided in the conditioned space 102. The air from the return air inlet 110 can be divided between air recycled by the main unit 106 and conditioned and returned to the conditioned space 102 and exhaust air that can be directed through exhaust heat recovery 112 and out of the main unit 106 to an ambient environment.

Exhaust heat recovery 112 can be included in main unit 106. Exhaust hear recovery can be a source of heat or a sink for heat for the working fluid circuit of main unit 106 Exhaust heat recovery 112 is configured to reject heat to or absorb heat from return air from return air inlet 110 that is being exhausted from the main unit 106. The return air from return air inlet 110 passing over the exhaust heat recovery 112 can reject heat, which is absorbed by fluid in exhaust heat recovery 112, such as working fluid of the working fluid circuit of main unit 106. In an embodiment, exhaust heat recovery 112 is located between return air inlet 110 and exhaust blower 114. The exhaust heat recovery 112 can be a heat exchanger configured such that the exhaust air of the main unit 106 can reject heat to or absorb heat from working fluid of the working fluid circuit included in main unit 106.

Exhaust blower 114 is a blower configured to direct air from return air inlet 110 out of the main unit 106. In an embodiment, exhaust blower 114 can draw an airflow over the exhaust heat recovery 112. As non-limiting examples, exhaust blower 114 can include one or more centrifugal blowers, one or more plenum fans, one or more direct-drive impellers, or the like.

Fresh air inlet 116 is an inlet configured to allow air from an ambient environment to enter the main unit 106. The air can be drawn into fresh air inlet 116 by operation of the main blower 118. The fresh air from fresh air inlet 116 can optionally be mixed with air from the return air inlet 110 to provide the primary airflow through main unit 106 and supply ducting 122 to the terminals 108.

Main blower 118 is a blower configured to drive air through main unit 106, through first heat exchanger 120, and into supply ducting 122. As non-limiting examples, main blower 118 can include one or more centrifugal blowers, one or more plenum fans, one or more direct-drive impellers, or the like.

First heat exchanger 120 is a heat exchanger configured such that the primary airflow driven by main blower 118 is cooled to a target temperature. The target temperature can be a temperature lower than a temperature desired at any of the zones 104 or terminals 108. First heat exchanger 120 can be a heat exchanger of the working fluid circuit of main unit 106. At first heat exchanger 120, the airflow driven by main blower 118 can exchange heat with a fluid in first heat exchanger 120, for example working fluid of the working fluid circuit, thus heating or cooling the airflow driven by main blower 118.

Supply ducting 122 is configured to receive the primary airflow after is passes over first heat exchanger 120, and direct the air to the plurality of terminals 108. The supply ducting 122 can optionally include flow controls to adjust the flow to particular terminals 108, for example to control supply of the primary airflow to particular groups of terminals 108 or individual terminals 108.

In an embodiment, heater 124 can optionally be included in main unit 106. The heater 124 can be provided between fresh air inlet 116 and first heat exchanger 120. In an embodiment, heater 124 can be provided between main blower 118 and first heat exchanger 120. Heater 124 can be any suitable heater, such as one or more gas burners, one or more electric heating elements, or the like. Heater 124 is configured to add heat to the primary airflow before it passes over first heat exchanger 120 when additional heat may be required to provide sufficient heating to the heating heat exchangers 134 of HVACR system 100. In an embodiment, controller 138 can determine if heater 124 is to supply additional heat, for example based on the ambient temperature, the temperature of air being returned to main unit 106 from the conditioned space 102, and/or the heating requirements such as desired temperatures at the terminals 108.

Second heat exchangers 126 can be heat exchangers of the working fluid circuit included in main unit 106. Second heat exchangers 126 can allow working fluid of the working fluid circuit to exchange heat with airflow passing over the second heat exchangers 126 prior to exiting main unit 106. The airflow exchanging heat at second heat exchangers 126 can be discharged from main unit 106 by way of second heat exchanger blowers 128. The second heat exchanger blowers 128 can be one or more fans or any other such suitable blower.

Heat distributor 130 is configured to direct heat from the working fluid circuit of main unit 106 to the heat distribution lines 132. In an embodiment, heat distributor 130 is configured to direct heat from the working fluid circuit of main unit 106 by distributing hot working fluid from the working fluid circuit to the heat distribution lines. In an embodiment, heat distributor 130 includes a branch controller configured to receive a flow of working fluid and separate and distributed hot gaseous working fluid from the flow of working fluid. In an embodiment, heat distributor 130 is a manifold configured to direct working fluid to heat distribution lines 132. In an embodiment, heat distributor 130 is configured to use another medium separate from the working fluid to convey heat to the heat distribution lines 132 and heat exchangers 134. In an embodiment, the heat distributor 130 is a heat exchanger configured to receive hot working fluid from any suitable point the working fluid circuit and to receive media from a return portion of heat distribution lines 132 and allows the hot working fluid to reject heat, which is absorbed by the media. The media can be any suitable media to be circulated through heat distribution lines 132 and heating heat exchangers 134, with a non-limiting example of the media being water. In an embodiment, one or more pumps can be provided at the heat distributor 130 or along the heat distribution lines 132 to circulate the working fluid or media through heat distribution lines 132.

Heat distribution lines 132 are a plurality of fluid lines configured to convey fluid from heat distributor 130 to the heating heat exchangers 134. In an embodiment, the heat distribution lines 132 include supply lines configured to convey hot working fluid from heat distributor 130 to the heating heat exchangers 134 and return lines configured return the working fluid to the working fluid circuit of main unit 106. In an embodiment, the heat distribution lines include supply lines 132 that extend from the heat distributor 130 to the heating heat exchangers 134, and return lines that extend from the heating heat exchangers 134 back to the heat distributor 130. In an embodiment, flow through some or all of the heat distribution lines 132 can be controllable such that the heating heat exchangers 134 can each receive a particular quantity, flow rate, and/or temperature of the working fluid or media such that each heating heat exchanger can achieve a target temperature. In an embodiment, control of the flow through heat distribution lines 132 can be achieved by including one or more controllable valves 140 along the heat distribution lines 132.

Controller 138 is configured to control HVACR system 100. Controller 138 can include one or more processors and one or more memories. Controller 138 can be configured to determine a target temperature for the primary airflow downstream of first heat exchanger 120, for example where the primary airflow enters supply ducting 122. In an embodiment, controller 138 receives the target temperature for the primary airflow from another device, for example a controller of a building management system (not shown). In an embodiment, the controller 138 can adjust operation of the working fluid circuit of main unit 106, operation of main blower 118, and/or the amounts of fresh and return air drawn through first heat exchanger 120 to achieve the target temperature for the primary airflow. In an embodiment, the controller 138 can be configured to control the recovery of heat at exhaust heat recovery 112, for example by controlling exhaust blower 114 and/or any flow controls directing air from return air inlet 110 out of main unit 106. In an embodiment, the controller 138 can be configured to determine a target temperature for one or more of the terminals 108. The target temperature for the terminals 108 can be based on, for example, thermostat settings or other desired temperature data for the zone associated with each terminal 108. In an embodiment, the controller 138 can control the distribution of fluid from the heat distributor 130 to each of the heating heat exchangers 134, for example by controlling valves located along the heat distribution lines 132. In an embodiment, controller 138 controls exhaust heat recovery 112, the working fluid circuit of main unit 106, and heater 124 to obtain the heat required to provide the target temperature at each of the terminals 108 in an energy efficient manner, for example by controlling the system such that the sources used to obtain sufficient heat are based on the power draw for operation of the working fluid circuit and any blowers or fans, effects on efficiency and/or capacity of the working fluid circuit, and the power draw or other fuel consumption by heater 124.

In operation, the working fluid circuit of main unit 106 provides cool working fluid to first heat exchanger 120. Air flowing through first heat exchanger 120 has heat absorbed by the cool working fluid, to bring a primary airflow to a desired temperature. Heat from the working fluid circuit, obtained from operation of the working fluid circuit, heat absorbed at first heat exchanger 120, and heat absorbed at exhaust heat recovery 112 can be provided to heating heat exchangers 134 directly or indirectly by the heat distributor 130 and heat distribution lines 132. In an embodiment, heat absorbed at first heat exchanger 120 can include heat that was added through operation of heater 124. The heat at heating heat exchangers 134 can be used to heat air at the terminals 108 to target temperatures for each terminal, which can then be distributed to the respective zones 104 of the conditioned space 102.

Figure 2:
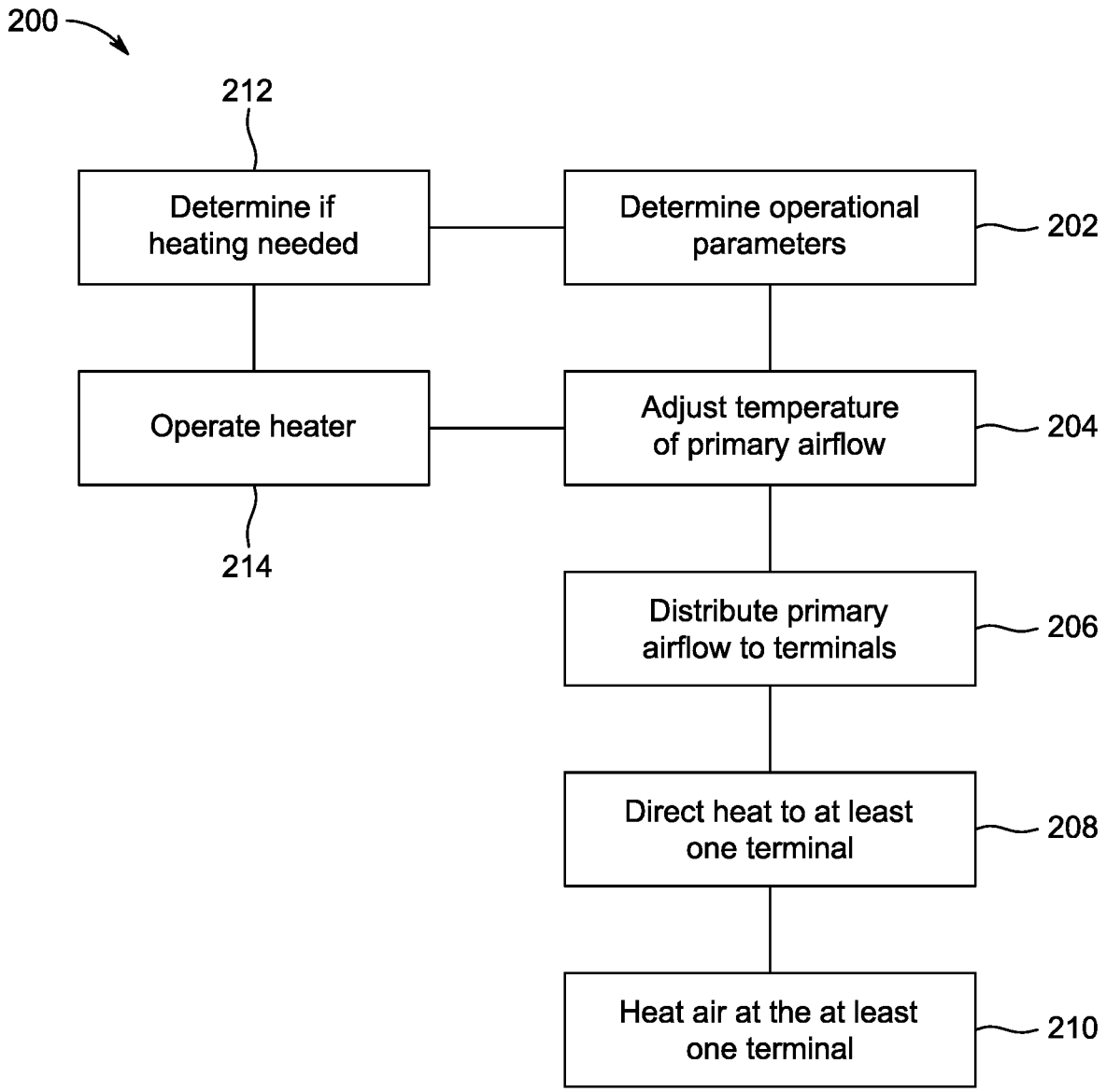
FIG. 2 shows a method of heating or cooling zones in a conditioned space.

FIG. 2 shows a method of heating or cooling zones in a conditioned space. Method 200 includes determining operational parameters 202, adjusting a temperature of a primary airflow 204, distributing the primary airflow to a plurality of terminals 206, directing heat to at least one of the plurality of terminals 208, and heating air at the at least one of the plurality of terminals 210.

Operational parameters are determined at 202. The operational parameters include operation of a working fluid circuit such as the working fluid circuit of main unit 106 to operate efficiently in both adjusting the temperature of the primary airflow at 204 and the directing of heat to the terminals at 208. The operational parameters can include parameters regarding utilization of exhaust heat recovery 112 and/or second heat exchanger 126 as sources or sinks for heat, such as flow rates of working fluid through the exhaust heat recovery 112 and/or second heat exchanger 126, operation of blowers such as exhaust blower 114 or second heat exchanger blower 128, or the like. In embodiments, the parameters can balance utilizations of the various sources and sinks of heat, such that each of the available sources and sinks are combined to obtain or reject heat sufficient for the working fluid circuit of the main unit 106 to adjust the temperature of the airflow at 204 and direct heat to the plurality of terminals at 208. The operational parameters can further include control of a compressor of the fluid circuit of main unit 106, main blower 118, first heat exchanger 120, and/or heat distributor 130 to efficiently satisfy the heat requirements for the adjustment of the temperature of the primary airflow at 204 and the directing of heat to the plurality of terminals at 208. The measurements of efficiency that can be used at 202 include, as non-limiting examples, coefficients of performance, carbon output, cost of energy consumed for operations, amounts of energy consumed for operations, expected values thereof, or any other suitable measure of efficiency in meeting heating and/or cooling needs for the conditioned spaces. In an embodiment, the determination of the operational parameters can be based on, for example, exhaust air temperatures, ambient air temperatures, suction or discharge temperatures or pressures in the working fluid circuit, and the like.

A temperature of a primary airflow is adjusted at 204. The temperature of the primary airflow can be adjusted by directing the primary airflow over the first heat exchanger 120 of a heating, ventilation, air conditioning, and refrigeration (HVACR) system. The first heat exchanger 120 can be configured to absorb heat from the primary airflow as the primary airflow passes over the first heat exchanger. In an embodiment, the primary airflow is directed over the first heat exchanger in a main unit of the HVACR system such as a rooftop HVACR unit. The first heat exchanger can be upstream of any division of ducts that receive the primary airflow and distribute the primary airflow to a plurality of terminals in zones within the conditioned space. The first heat exchanger can be a first heat exchanger included in a heat pump. The temperature of the primary airflow can be adjusted to a temperature that is lower than a temperature requested by any of the terminals in the conditioned space. In an embodiment, when operating in a cooling mode, heat absorbed from the primary airflow can be carried through a fluid circuit of the HVACR system, for example to be rejected at a condenser, or to be distributed to the terminals at 208 as discussed below.

In an embodiment, method 200 can optionally further include determining whether heat needs to be added for sufficient heating at the terminals at 212. The determination can be made by, for example, a controller of the HVACR system. The determination can be based on target temperatures for the terminals, for example based on desired temperature settings, operating modes, flow rates for the terminals, or any other such suitable parameter affecting the heat requirements of the terminals, and the heat that can be obtained by the HVACR system. The heat that can be obtained by the HVACR system can include, for example, heat from adjusting the temperature of the primary airflow at 204 and heat recovered from at least some of the zones of the conditioned space. Heat from adjusting the temperature of the primary airflow at 204 can be determined, for example, based on ambient temperatures or the like. Heat recovered from at least some of the zones of the conditioned space can be determined, for example, based on temperatures and optionally flow rates of return air from the conditioned space to the HVACR system. In an embodiment, the fluid circuit of the HVACR system can include a heat exchanger configured to absorb heat from return air from the conditioned space, for example at an exhaust of the HVACR system. The heat requirements of the terminals can be compared to the heat that can be obtained by the HVACR system. When the heat that can be obtained by the HVACR system meets or exceeds the heat requirements of the terminals, the method can proceed through 204, 206, 208, and 210. In an embodiment, the determination of whether heat is to be added at 212 can include determining whether the addition of heat by the heater can allow for operational parameters to be selected at 202 that improve the efficiency of the system when the heater is operated at 214.

Optionally, when it is determined at 212 that heat needs to be added for sufficient heating at the terminal, a heater can be operated 214 to add heat to the primary airflow prior to the adjustment of the temperature of the primary airflow at 204. This can be performed using, any suitable heater disposed upstream of the first heat exchanger of the HVACR system. The heater can be, for example, a gas heater, an electric heater, or the like. In an embodiment, the heat production from the heater and/or the temperature of heated air can be controlled based on the heat that is to be added for sufficient heating of the terminals. The heat added at 214 can be absorbed at the first heat exchanger in 204, increasing heat in the working fluid circulated in the fluid circuit of the HVACR system, which can in turn be distributed to the terminals at 208.

The primary airflow is distributed to a plurality of terminals at 206. The terminals can be distributed such that one or more of the plurality of terminals each provide conditioned air to one of a plurality of zones in the conditioned space. The distribution of the primary airflow to the terminals at 206 can be achieved using ducts configured to receive the primary airflow, for example from the rooftop unit of the HVACR system where the temperature of the primary airflow is adjusted at 204, and to divide the flow and direct it to each of the terminals.

Heat is directed to at least one of the terminals at 208. The heat directed to each terminal can be controlled, such that each terminal can heat its respective portion of the primary airflow to a target temperature. The target temperature can be selected based on one or more parameters for conditioning a zone, such as, as non-limiting examples, an operating mode of the HVACR system such as a heating or cooling mode, a current temperature in the zone served by the terminal, a target temperature for the zone, or the like. In an embodiment, the heat can be directed to the at least one terminal by directing hot working fluid from a fluid circuit of the main unit of the HVACR system to heat exchanges provided at the terminals. For example, the fluid circuit can include a flow path directing hot working fluid such as fluid being discharged from a compressor to the terminals. The working fluid can be, for example, any suitable refrigerant used in the main unit of the HVACR system. The flow path can include flow controls configured to control the allocation of the hot working fluid to the terminals. In an embodiment, the heat can include heat absorbed at the first heat exchanger when adjusting the temperature of the primary airflow at 204 and/or heat absorbed from return air or exhaust air flows of the HVACR system. In an embodiment, the heat can include heat absorbed at the first heat exchanger following heating of the primary airflow by a heater at optional 214 as discussed above. In an embodiment, the hot working fluid can be obtained and directed to the terminals through the use of a branch controller configured to separate hot gaseous working fluid from a flow of working fluid and direct the hot gaseous working fluid into one or more channels, with the one or more channels configured to convey the hot gaseous working fluid to the terminals. In an embodiment, the heat can be directed to the terminals at 208 through the use of a process fluid. The process fluid can be any suitable fluid for absorbing heat from the main unit of the HVACR system and conveying it to the terminals, such as, as a non-limiting example, water. The process fluid can absorb heat from hot working fluid of the main unit of the HVACR system at a heat exchanger, for example a heat exchanger receiving hot working fluid discharged from a compressor of the HVACR system. The process fluid can be circulated to the terminals, for example using one or more pumps and piping configured to convey the process fluid to the terminals. The process fluid can reject heat at the terminals and be directed back to the heat exchanger at the main unit of the HVACR system to absorb heat again. In an embodiment, the process fluid is heated to a target temperature at the heat exchanger. In an embodiment, the flow of the process fluid to the one or more terminals is controlled to a determined flow rate. In an embodiment, the determined flow rate is determined based on a desired temperature at the one or more terminals and a temperature of the primary airflow. In an embodiment, heat is directed to only some of the terminals of the plurality of terminals. In an embodiment, all terminals of the plurality of terminals have heat directed to them at 208.

Air is heated at the at least one terminal at 210. The heat that is directed to the terminals at 208 is provided to air passing through the terminal. The air passing through the terminal is a portion of the primary flow that is distributed to that terminal at 206. The heating of the air can be performed using a heat exchanger located at the terminal, the heat exchanger providing heat from the hot working fluid or process fluid to the portion of the primary flow passing through the heat exchanger at that terminal. This can heat the air at that terminal from the temperature it was adjusted to at 204 to a target temperature to be provided to the zone receiving conditioned air from that terminal. In an embodiment, a rate of flow of the air through the heat exchanger can be controlled to achieve the target temperature. In an embodiment, a rate of flow of the air from the terminal to the zone can be controlled to meet heating, cooling, or ventilation demands.

FIG. 3 shows an example of a working fluid circuit for an HVACR system according to an embodiment. Working fluid circuit 300 includes compressor 302 and flow reverser 304. The compressor 302 can be any suitable compressor. The compressor 302 can be a variable-speed compressor. The compressor 302 can be operated at a speed set to achieve a required pressure differential required to satisfy the heating or cooling requirements of working fluid circuit 300. The flow reverser 304 can direct the discharge of compressor 302 to one of flow distributor 306 or heat exchanger 318.

Flow distributor 306 is configured to distribute working fluid to each of direct heat exchanger 308, exhaust heat recovery 310, and terminal heat exchange 312. Flow distributor 306 can be a branch controller. Expanders 314 can be provided in the flow paths between flow distributor 306 and each of direct heat exchanger 308, exhaust heat recovery 310, and terminal heat exchange 312.

Direct heat exchanger 308 is a heat exchanger used to adjust a primary airflow to a target temperature. Direct heat exchanger 308 is a heat exchanger of the main unit, such as first heat exchanger 120 as discussed above and shown in FIG. 1. Flow distributor 306 is configured to supply either gaseous working fluid to direct heat exchanger 308 when direct heat exchanger 308 is in a heating mode, and supply liquid working fluid to direct heat exchanger 308 when direct heat exchanger 308 is in a cooling mode. When in the cooling mode, the liquid refrigerant passes through the corresponding expander 314 prior to entering direct heat exchanger 308. When in the heating mode, the gaseous refrigerant passes to direct heat exchanger 308 first, then the working fluid from direct heat exchanger 308 passes through the corresponding expander 314 returns to flow distributor 306.

Exhaust heat recovery 310 is a heat exchanger that can exchange heat with exhaust air from the structure served by HVACR system including working fluid circuit 300. The exhaust heat recovery 310 can be used as a source or sink for energy based on the needs of the HVACR system. Exhaust heat recovery 310 can be, for example, exhaust heat recovery 112 as discussed above and shown in FIG. 1. Flow distributor 306 is configured to supply either gaseous working fluid to exhaust heat recovery 310 when exhaust heat recovery 310 is used as a sink for heat in the HVACR system, and supply liquid working fluid to exhaust heat recovery 310 when exhaust heat recovery 310 is used as a source for heat in the working fluid circuit 300. When used as a source for heat in the working fluid circuit 300, the liquid refrigerant passes through the corresponding expander 314 prior to entering exhaust heat recovery 310. When used as a sink for heat in the working fluid circuit 300, the gaseous refrigerant passes to exhaust heat recovery 310 first, then the working fluid from exhaust heat recovery 310 passes through the corresponding expander 314 returns to flow distributor 306. The utilization of exhaust heat recovery 310 can include controlling an amount of flow of the working fluid through exhaust heat recovery 310. In an embodiment, the flow of exhaust from the building through exhaust heat recovery 310 can be determined based on building ventilation and pressure requirements.

Terminal heat exchange 312 is configured to provide heat to heating heat exchangers at terminals, such as heating heat exchangers 134 described above and shown in FIG. 1, such that the heating heat exchangers can meet local heating demands. In an embodiment, terminal heat exchange 312 can distribute hot working fluid to the heating heat exchangers. In an embodiment, terminal heat exchange 312 is a heat exchanger configured to allow a process fluid to absorb heat from the working fluid of circuit 300, with the process fluid circulated to the heating heat exchangers. The terminal heat exchanger 312 is configured to receive gaseous working fluid from flow distributor 306, and return working fluid to the flow distributor 306 by a flow path including the corresponding expander 314.

Flow distributor 306 can be controlled to allocate gaseous or liquid working fluid to direct heat exchanger 308 based on heating or cooling demand for the primary airflow. Flow distributor 312 can be controlled to allocate gaseous working fluid to terminal heat exchange 312 based on heating demands at the terminals. Gaseous or liquid working fluid can be allocated to exhaust heat recovery 310 based on a determined utilization of the exhaust heat recovery selected to efficiently allow HVACR system 300 to balance heating and cooling of the working fluid, for example to reduce a pressure differential required across compressor 302 in order to meet the heating and cooling demands on HVACR system 300.

Expander 316 can be positioned between flow distributor 306 and the heat exchanger 318. Heat exchanger 318 is configured to be used as a source or sink for heat in the HVACR system 300. Heat exchanger 318 can allow exchange of heat between the working fluid and any suitable source, such as air of an ambient environment of HVACR system 300. Operation of the heat exchanger 318 can be based on efficiently meeting the heating and/or cooling requirements for direct heat exchanger 308 and terminal heat exchange 312, in combination with exhaust heat recovery 310. The utilization of exhaust heat recovery 310 and heat exchanger 318 can be controlled based on the respective conditions at each to select efficient sources or sinks for heat in HVACR system 300. The utilization of heat exchanger 318 can be controlled by, for example, controlling the flow of working fluid through heat exchanger 318 and/or controlling the flow of the source over heat exchanger 318 such as by controlling fans or the like. For example, ambient temperatures at heat exchanger 318 and exhaust air temperatures at exhaust heat recovery 310 can be used to determine the effectiveness of each as a source or sink, and the utilization of the sources or sinks can be selected to efficiently meet heating or cooling requirements for HVACR system 300, for example by reducing the required pressure differential across compressor 302.

The direction of working fluid from compressor 302 through the system can also be based on the operational needs of the HVACR system 300, for example whether heating or cooling is the net requirement at flow distributor 306. The net requirement at flow distributor 306 can be the sum of heating or cooling requirements at direct heat exchanger 308, the heat absorbed from or rejected to exhaust at exhaust heat recovery 310, and the heating requirements, if any, of terminal heat exchange 310. When the net requirement at flow distributor 306 is heating, the flow distributor 306 can receive the working fluid directly from flow reverser 304. When the net requirement at flow distributor 306 is cooling, flow reverser 304 can direct the discharge of compressor 302 to heat exchanger 318, and flow distributor 306 can receive flow from heat exchanger 318 by way of expander 316.

Aspects:

It is understood that any of aspects 1-9 can be combined with any of aspects 10-16.

Aspect 1. A method for providing heating or cooling to a plurality of zones in a conditioned space, comprising:

adjusting a temperature of a primary airflow using a heating, ventilation, air conditioning, and refrigeration (HVACR) system including a heat pump circuit;

distributing the primary airflow to a plurality of terminals, each of the plurality of zones being associated with at least one of the plurality of terminals;

directing heat from the HVACR system to at least one of the plurality of terminals; and heating air at the at least one of the plurality of terminals using the heat directed from the heat pump circuit.

Aspect 2. The method according to aspect 1, wherein the HVACR system further includes an exhaust heat recovery and a second heat exchanger, and the method further comprises determining utilization of the exhaust heat recovery and the second heat exchanger as sources or sinks for heat in the HVACR system.

Aspect 3. The method according to aspect 2, wherein the determination of utilization of the exhaust heat recovery and the second heat exchanger is based on an energy consumption for operation of the heat pump circuit.

Aspect 4. The method according to any of aspects 1-3, further comprising determining whether additional heat is to be added, and when additional heat is to be added, using a heater to add heat to the primary airflow prior to the adjustment of the temperature of the primary airflow using the heat pump circuit.

Aspect 5. The method according to any of aspects 1-4, wherein directing heat from the heat pump to the at least one of the plurality of terminals includes heating a process fluid using heat from the heat pump circuit and circulating the process fluid to the at least one of the plurality of terminals.

Aspect 6. The method according to any of aspects 1-5, wherein directing heat from the heat pump circuit to the at least one of the plurality of terminals includes directing hot working fluid from the heat pump circuit to the at least one of the plurality of terminals.

Aspect 7. The method according to aspect 6, wherein the hot working fluid is in a gaseous state.

Aspect 8. The method according to aspect 7, wherein directing the hot working fluid includes directing working fluid including the hot working fluid through a branch controller.

Aspect 9. The method according to any of aspects 1-8, wherein the heat directed from the heat pump circuit to at least one of the plurality of terminals is obtained at least in part from a heat exchanger configured to exchange heat with an exhaust airflow of the HVACR system.

Aspect 10. The method according to any of aspects 1-9, wherein the heat directed from the heat pump circuit to at least one of the plurality of terminals is obtained at least in part from operation of the heat pump circuit to adjust the temperature of the primary airflow.

Aspect 11. A heating, ventilation, air conditioning, and refrigeration (HVACR) system, comprising:

a heat pump circuit configured to exchange heat with a primary airflow;

a duct system configured to distribute the primary airflow to a plurality of terminals, each of the plurality of terminals including a heat exchanger, each of the plurality of terminals being associated with one of a plurality of zones of a conditioned space; and a heat distributor configured to direct heat from the heat pump circuit to the heat exchangers of the plurality of terminals such that the heat exchangers of at least one of the plurality of terminals add heat to air at said at least one of the plurality of terminals.

Aspect 12. The HVACR system according to aspect 11, wherein the heat pump circuit includes a heat recovery and a second heat exchanger configured to exchange heat with a source, and the HVACR system further comprises a controller configured to determine utilization of the heat recovery and the second heat exchanger as sources or sinks for heat in the heat pump circuit.

Aspect 13. The HVACR system of claim 12, wherein the controller is configured to determine utilization of the heat recovery exchanger and the second heat exchanger as sources or sinks for heat in the heat pump circuit based on an energy consumption of operation for the heat pump circuit.

Aspect 14. The HVACR system according to any of aspects 11-13, further comprising a heater located upstream of a location where the heat pump is configured to exchange heat with the primary airflow.

Aspect 15. The HVACR system according to aspect 14, further comprising a controller configured to determine an additional heat requirement and to operate the heater based on the additional heat requirement.

Aspect 16. The HVACR system according to any of aspects 11-15, wherein the heat distributor includes a heat exchanger configured to allow working fluid of the heat pump to reject heat to a process fluid, and process fluid piping configured to distribute the process fluid to the heat exchangers of the plurality of terminals.

Aspect 17. The HVACR system according to aspect 16, wherein the process fluid includes water.

Aspect 18. The HVACR system according to any of aspects 11-17, wherein the heat distributor includes a branch controller configured to separate hot gaseous working fluid from a working fluid flow of the heat pump circuit and working fluid piping configured to distribute the hot gaseous working fluid to the heat exchangers of the plurality of terminals.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method for providing heating or cooling to a plurality of zones in a conditioned space, comprising:

adjusting a temperature of a primary airflow using a heating, ventilation, air conditioning, and refrigeration (HVACR) system including a heat pump circuit, the heat pump circuit including a compressor;

after adjusting the temperature of the primary airflow, distributing the primary airflow to a plurality of terminals, each of the plurality of zones being associated with at least one of the plurality of terminals;

directing heat from the heat pump circuit to at least one of the plurality of terminals; and heating air at the at least one of the plurality of terminals using the heat directed from the heat pump circuit, wherein directing heat from the heat pump circuit to the at least one of the plurality of terminals includes directing hot working fluid from the heat pump circuit to the at least one of the plurality of terminals, wherein the hot working fluid includes a refrigerant of the heat pump circuit.

2. The method of claim 1, wherein the heat pump circuit includes an exhaust heat recovery and a second heat exchanger, and the method further comprises determining utilization of the exhaust heat recovery and the second heat exchanger as sources or sinks for heat in the heat pump circuit.

3. The method of claim 2, wherein the determining of utilization of the exhaust heat recovery and the second heat exchanger is based on an energy consumption for operation of the heat pump circuit.

4. The method of claim 1, further comprising determining whether additional heat is to be added, and when additional heat is to be added, using a heater to add heat to the primary airflow prior to the adjusting of the temperature of the primary airflow using the heat pump circuit.

5. The method of claim 1, wherein the hot working fluid is in a gaseous state.

6. The method of claim 5, wherein directing the hot working fluid includes directing working fluid including the hot working fluid through a branch controller.

7. The method of claim 1, wherein the heat directed from the heat pump circuit to at least one of the plurality of terminals is obtained at least in part from a heat exchanger configured to exchange heat with an exhaust airflow of the HVACR system.

8. The method of claim 1, wherein the heat directed from the heat pump circuit to at least one of the plurality of terminals is obtained at least in part from operation of the heat pump circuit to adjust the temperature of the primary airflow.

9. A heating, ventilation, air conditioning, and refrigeration (HVACR) system, comprising:

a heat pump circuit configured to exchange heat with a primary airflow, the heat pump circuit including a compressor;

a duct system configured to distribute the primary airflow to a plurality of terminals following the exchange of heat with the primary airflow, each of the plurality of terminals including a heat exchanger, each of the plurality of terminals being associated with one of a plurality of zones of a conditioned space; and a branch controller configured to separate hot working fluid from a working fluid flow of the heat pump circuit and working fluid piping configured to distribute the hot working fluid from the branch controller to at least one of the heat exchangers of the plurality of terminals, wherein the working fluid includes a refrigerant of the heat pump circuit.

10. The HVACR system of claim 9, wherein the heat pump circuit includes a heat recovery exchanger and a second heat exchanger configured to exchange heat with a source, and the HVACR system further comprises a controller configured to determine utilization of the heat recovery exchanger and the second heat exchanger as sources or sinks for heat in the heat pump circuit.

11. The HVACR system of claim 10, wherein the controller is configured to determine utilization of the heat recovery exchanger and the second heat exchanger as sources or sinks for heat in the heat pump circuit based on an energy consumption of operation for the heat pump circuit.

12. The HVACR system of claim 9, further comprising a heater located upstream of a location where the heat pump circuit is configured to exchange heat with the primary airflow.

13. The HVACR system of claim 12, further comprising a controller configured to determine an additional heat requirement and to operate the heater based on the additional heat requirement.

14. The HVACR system of claim 9, wherein the branch controller is configured to separate hot gaseous working fluid from the working fluid flow of the heat pump circuit and the working fluid piping is configured to distribute the hot gaseous working fluid to the heat exchangers of the plurality of terminals.

* * * * *